US005144889A

United States Patent [19]

Alig et al.

[11] Patent Number: 5,144,889

[45] Date of Patent: Sep. 8, 1992

[54] APPARATUS FOR FORMING NEGATIVELY BUOYANT HIGH-DENSITY TRASH SLUGS

[75] Inventors: Craig S. Alig, Arnold; Peter S. McGraw, Severna Park; Christopher C. Chiodo, Annapolis; William K. Upton, III, Chester, all of Md.

[73] Assignee: The United States of America as represented by the Secretary of the Navy, Washington, D.C.

[21] Appl. No.: 721,076

[22] Filed: Jun. 26, 1991

[51] Int. Cl.[5] ..... B30B 15/30

[52] U.S. Cl. ..... 100/74; 53/527; 100/125; 100/215; 100/229 A; 100/245; 100/246; 141/73; 141/80

[58] Field of Search ..... 100/35, 37, 73–75, 100/125, 215, 218, 229 A, 240, 245, 246, 252; 53/527; 141/73, 80, 249

[56] References Cited

U.S. PATENT DOCUMENTS

| | | | |
|---|---|---|---|
| 3,195,447 | 7/1965 | Taylor | 100/74 |
| 3,330,088 | 7/1967 | Dunlea, Jr. | 100/35 X |
| 3,405,744 | 10/1968 | Bowman | 100/215 X |
| 3,563,168 | 2/1971 | Doninger | 100/215 |
| 3,654,048 | 4/1972 | Bathgate | 100/73 X |
| 3,729,107 | 4/1973 | Present | 100/73 X |
| 3,911,807 | 10/1975 | Birnbaum | 100/218 X |
| 3,934,038 | 1/1976 | Kerr | 100/74 X |
| 4,346,653 | 8/1982 | Rodak | 100/73 X |
| 4,676,154 | 6/1987 | Steinort | 100/37 |
| 4,809,600 | 3/1989 | Yamamoto et al. | 100/245 X |
| 4,848,222 | 7/1989 | Fleissner | 100/35 |
| 4,897,222 | 1/1990 | Müntzel et al. | 141/80 X |

FOREIGN PATENT DOCUMENTS

| | | | |
|---|---|---|---|
| 1235223 | 2/1967 | Fed. Rep. of Germany | 100/73 |
| 8003555 | 1/1982 | Netherlands | 53/527 |

*Primary Examiner*—Harvey C. Hornsby
*Assistant Examiner*—Stephen F. Gerrity
*Attorney, Agent, or Firm*—Charles D. Miller

[57] ABSTRACT

A trash compactor is provided having at least a hollow compaction chamber vertically disposed on a base and a compacting ram slidaly fitted within the compaction chamber, such that the compacting ram is disposed above the trash to be compacted. The trash to be compacted is first loaded into the compaction chamber between the base and the compacting ram. A downward compaction force is then applied to the compacting ram to compact the trash within the compaction chamber to the required density. The downward compaction force is then maintained while the compaction chamber is removed from around the compacted trash. Finally, the downward compaction force is removed from the compacting ram thereby leaving a compacted trash slug. The trash may be wetted prior to compaction to further enhance the delamination characteristics of the trash slug.

3 Claims, 5 Drawing Sheets

APPARATUS FOR FORMING NEGATIVELY BUOYANT HIGH-DENSITY TRASH SLUGS

The invention described herein may be manufactured and used by or for the Government of the United States of America for governmental purposes without payment of any royalties thereon or therefor.

FIELD OF THE INVENTION

The invention relates generally to trash compacting and more particularly to a method and apparatus for forming negatively buoyant, high-density trash slugs for the overboard discharge of unpulped trash from ships.

BACKGROUND OF THE INVENTION

World-wide environmental concerns have generated a broad range of new national and international waste regulations. In particular, the Marine Plastic Pollution Research and Control Act of 1987 (United States Public Law 100-220) and Annex V of the International Convention for the Prevention of Pollution from Ships (MARPOL) limit the overboard discharge of unpulped trash from ships. U.S. Navy regulations and policy (OPNAVINST 5090.1A) prohibit the discharge of (floating) solid waste within certain areas. Accordingly, shipboard trash compactors need to generate high-density trash slugs that are negatively buoyant.

Research has shown that negatively buoyant trash slugs can be formed in compactors having an extremely high compacting ram face pressure (e.g. 440 pounds per square inch). Commercially available, high-pressure trash compactors use a compacting ram to: 1) compact the trash into a trash slug within a stationary compaction chamber, and 2) eject the compacted trash slug from the stationary compaction chamber. However, ejection of the trash slug in this manner results in a certain amount of trash delamination as the trash slug exits the compaction chamber. Shear forces act on the sides of the trash slug as the slug is pushed from the compaction chamber causing trash slug delamination. Unfortunately, delamination frequently prevents the trash slug from achieving negative buoyancy even if the compacting ram is capable of generating the necessary compaction forces within the compaction chamber.

SUMMARY OF THE INVENTION

Accordingly, it is an object of the present invention to provide a method and apparatus that forms negatively buoyant, high-density trash slugs for the overboard discharge from ships in compliance with domestic and international law.

Another object of the present invention is to provide a method and apparatus for forming high-density trash slugs such that the method and apparatus minimizes delamination of the trash slug upon ejection/removal of the trash slug from the apparatus.

Other objects and advantages of the present invention will become more obvious hereinafter in the specification and drawings.

In accordance with the present invention, a trash compactor is provided having at least a hollow compaction chamber vertically disposed on a base and a compacting ram slidably fitted within the compaction chamber, such that the compacting ram is disposed above the trash to be compacted. In order to form a negatively buoyant, high-density trash slug, the trash to be compacted is first loaded into the compaction chamber between the base and the compacting ram. A downward compaction force is then applied to the compacting ram to compact the trash within the compaction chamber to the required density. The downward compaction force is then maintained while the compaction chamber is removed from the compacted trash. Finally, the downward compaction force is removed from the compacting ram thereby leaving a compacted trash slug that may be tied, bundled or bagged for final disposition. The trash may be wetted prior to compaction to further enhance the delamination characteristics of the trash slug.

BRIEF DESCRIPTION OF THE DRAWINGS

FIG. 2(*b*) is a cross-sectional, side view of the trash compactor of FIG. 1 configured as it would be during the second phase of ejecting the trash slug;

DETAILED DESCRIPTION OF THE INVENTION

Figure 1:
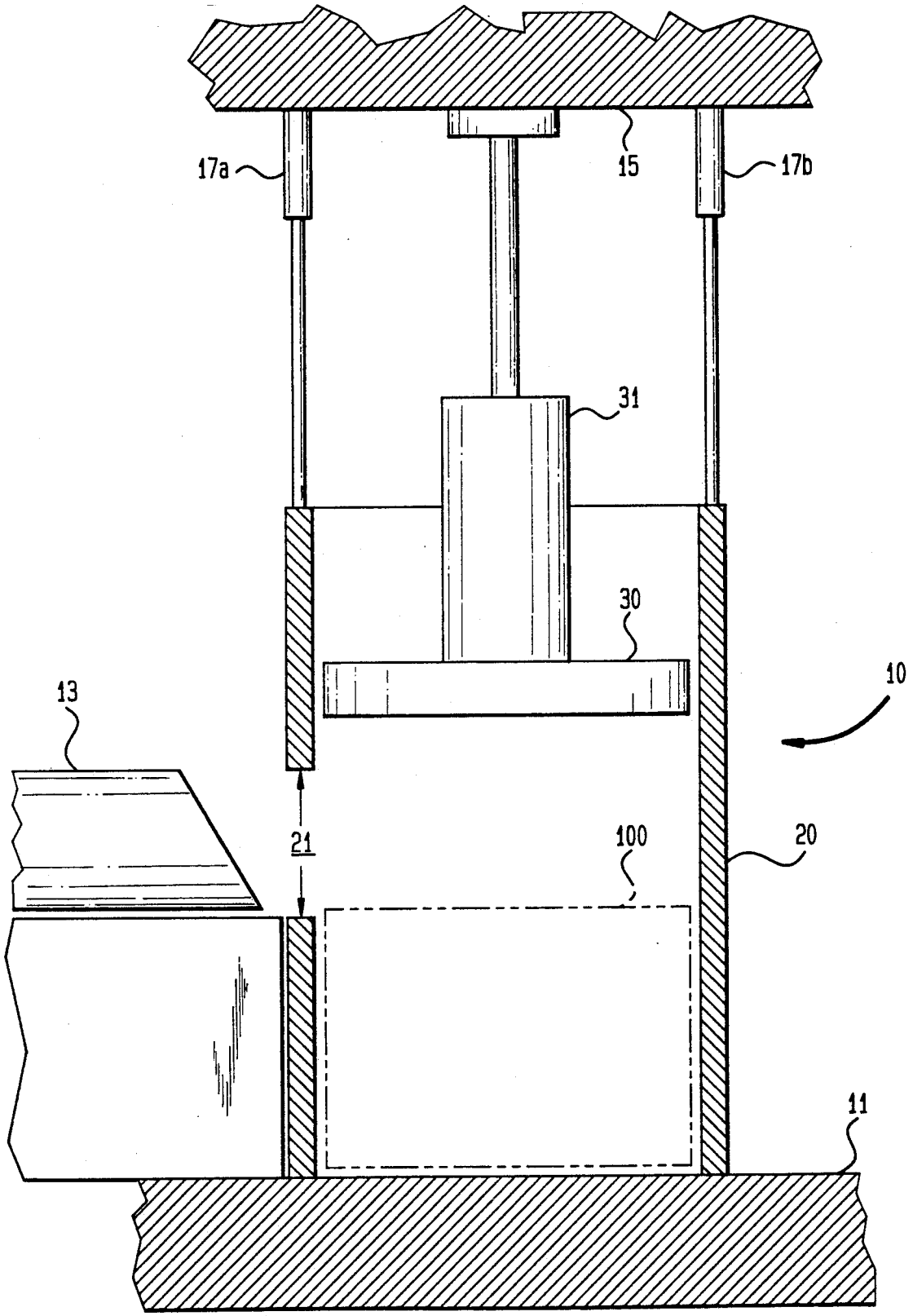
FIG. 1 is a cross-sectional, side view of a preferred embodiment trash compactor according to the present invention configured for receiving trash to be compacted.

Referring now to the drawings, a preferred embodiment of the method and apparatus of the present invention will be described in detail with reference to FIGS. 1, 2(*a*) and 2(*b*). Like reference numerals will be used for common elements. It is to be appreciated at the outset that this description is not limiting and that the novel aspects of the present invention may be practiced in a variety of ways. This is of particular importance since many existing (shipboard) trash compactors may be renovated to make use of the present invention in light of current domestic and international pollution regulations. Accordingly, only the novel aspects of the present invention will be described in FIGS. 1, 2(*a*) and 2(*b*) since the details of a particular system will vary greatly. In FIG. 3, additional features that further enhance the method and apparatus of the present invention will be described.

Figure 2A:
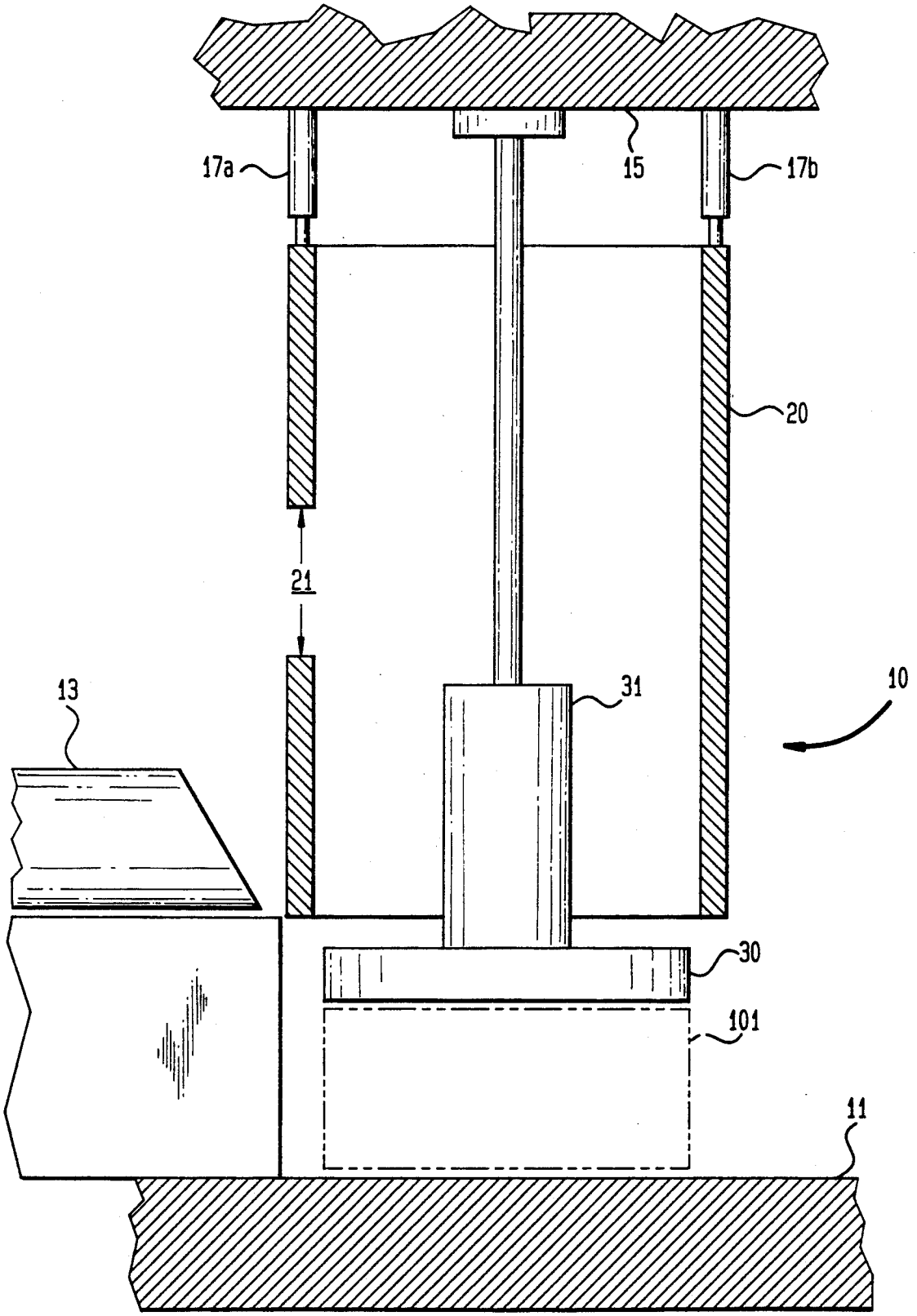
FIG. 2(*a*) is a cross-sectional, side view of the trash compactor of FIG. 1 configured as it would be during the first phase of ejecting the trash slug.
Figure 2B:
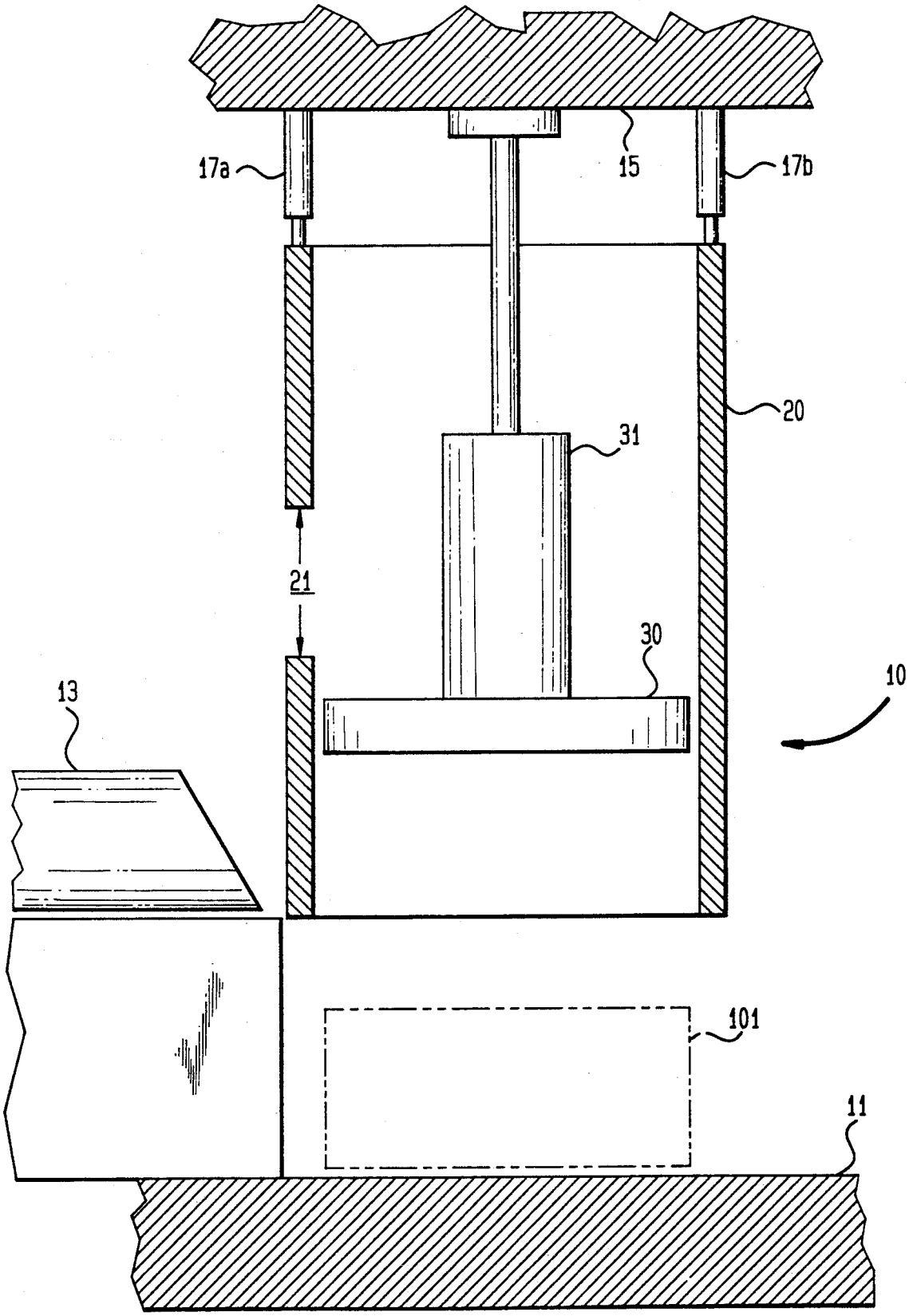
Figure 3:
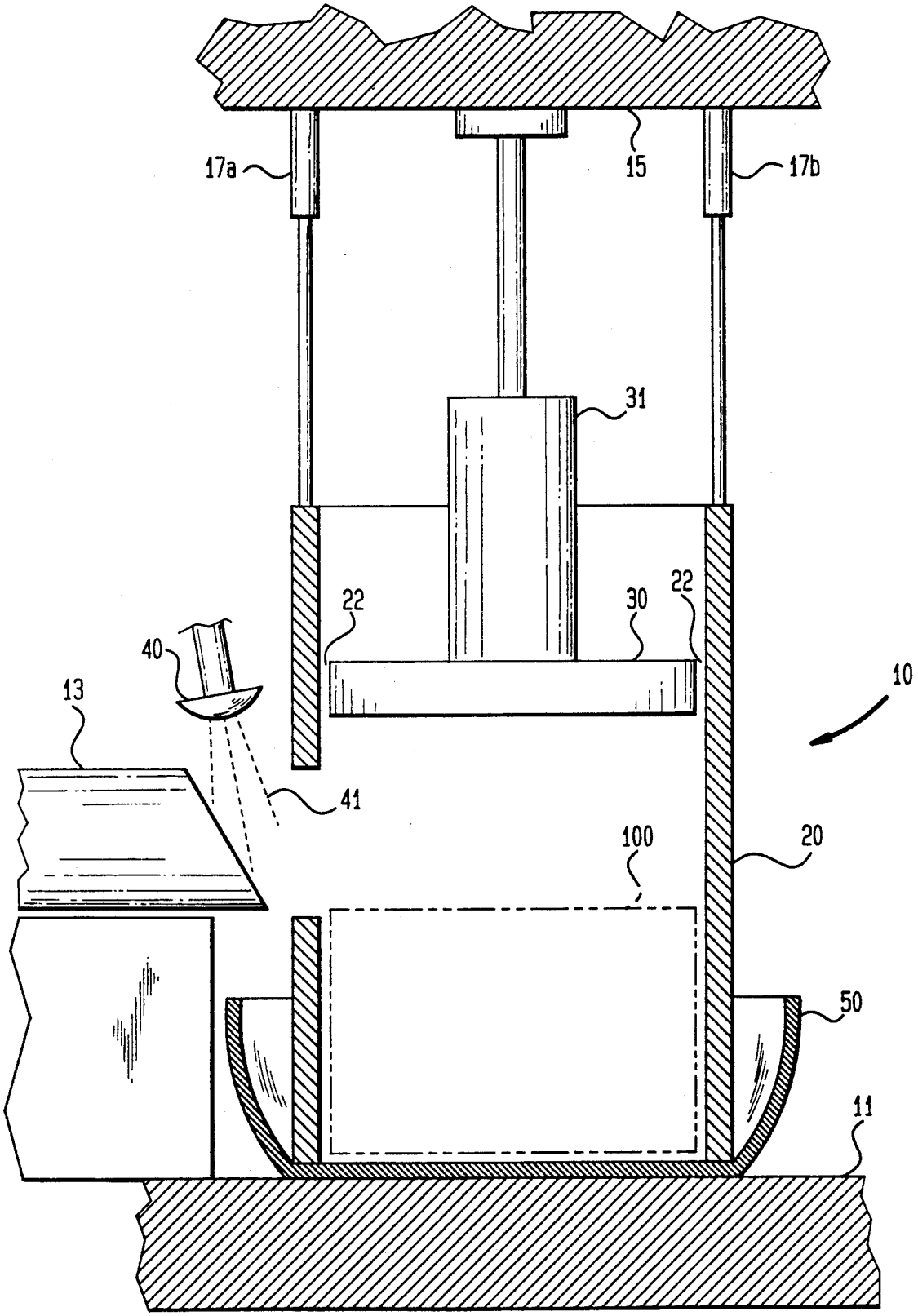
FIG. 3 is a cross-sectional, side view of the trash compactor of FIG. 1 configured with several additional features that enhance both the method and apparatus of the present invention.

In particular, FIGS. 2(*a*) and 2(*b*) are crosssectional, side views of a trash compactor 10 in various stages of its operation cycle according to the present invention. In FIG. 1, compactor 10 is configured to receive trash to be compacted. The key elements of compactor 10 are its hollow sleeve 20 and its compacting ram 30, which is slidably fitted within sleeve 20. Sleeve 20 extends vertically from a fixed base 11. An opening 21 is provided in the side of sleeve 20 to allow the loading of trash to be compacted into sleeve 20. Note that throughout the drawings the trash (in both its "to be compacted" and compacted "slug" state) will be indicated generally by a dotted line box for sake of clarity. Accordingly, the trash to be compacted 100 resides within sleeve 20 on top of base 11. Thus, sleeve 20 restricts any radial movement of the trash to be compacted 100. The volume that the trash to be compacted 100 occupies within sleeve 20 is also known as the compaction chamber.

The trash to be compacted 100 may be loaded into sleeve 20 by any one of a variety of conventional manual or automatic means and in no way limits the present invention. For purposes of description, a shear ram 13 is used to push the trash through opening 21. Naturally, shear ram 13 may be manually or automatically operated.

Once the trash to be compacted 100 is loaded into the compaction chamber portion of sleeve 20, the shear ram 13 is left in its forward position thereby filling the opening 21 in the side of sleeve 20. This is done to prevent the trash from bridging the opening 21 and possibly exerting a radial force on the compaction ram 30. Then, compacting ram 30 is pushed downward with a compaction force sufficient to compact trash 100 into a trash slug having a density that satisfies the requirements of negative buoyancy (i.e., a density greater than 64.1 pounds per cubic foot). Typically, the downward compaction force is supplied by a hydraulically activated cylinder 31 connected to compacting ram 30. As shown, the hydraulic cylinder 31 is mounted from an overhead support 15, shown only in section. The above described "load and compact" cycle may be repeated by simply raising compacting ram 30 in order to clear the opening 21 and then cycling shear ram 13 back and forth. Additional trash to be compacted may then be loaded into the compaction chamber portion of sleeve 20. The load and compact cycle is repeated until the trash is compacted to a desired height.

At this point, as shown in FIG. 2(*a*), the first phase of the ejection/removal cycle takes place. In particular, shear ram 13 is withdrawn from the opening 21 and sleeve 20 is raised to a height above base 11 sufficient to clear the height of the compacted trash slug 101. Sleeve 20 may be raised in any one of a variety of ways. For example, two hydraulic lifting cylinders 17*a* and 17*b* mounted from overhead support 15 may be used. More lifting cylinders may be used as needed.

Although sleeve 20 is no longer restraining trash slug 101 in the radial direction, the downward compaction force is still applied via compacting ram 30. In this way, delamination of the trash slug layers (not shown), formed by several load and compact cycles, is prevented. By removing sleeve 20 from trash slug 101 while the axial, downward compaction load from ram 30 is still applied, delamination of trash slug 101 due to either: 1) gravitational forces acting on an unconstrained portion of trash slug 101 or 2) frictional forces due to the raising of sleeve 20 from around trash slug 101, is prevented.

The second phase of the ejection/removal cycle will now be described with the aid of FIG. 2(*b*). After sleeve 20 is raised to the specified height clear of trash slug 101, the downward compaction force is removed as compacting ram 30 is raised by the hydraulic cylinder 31. By preventing vertical delamination during the exertion of the aforementioned shear forces, the resulting trash slug 101 maintains a density sufficient to achieve negative buoyancy. The trash slug 101 may be tied, bundled or bagged for removal from base 11.

The novel aspects of the present invention may be further enhanced in a variety of ways. As shown in FIG. 3, a sprayer 40 may be supplied to wet the trash with a liquid 41 as it is loaded into the compaction chamber portion of sleeve 20 or, alternatively, once it is in sleeve 20. Liquid 41 may serve one or more purposes depending on its nature. For example, if liquid 41 is seawater, it can be used to displace the air in the trash slug 101 during the compact cycle to increase the density of trash slug 101 (i.e., pores are filled with water instead of air). Furthermore, by displacing the air in the trash laminations, external air pressure can help hold trash slug 101 together in the same manner that a suction cup would be held in place. In this way, prevention of vertical delamination after removal of the downward compaction force (FIG. 2(*b*)) is enhanced. This gives the operator more time to tie, bundle or bag trash slug 101. Alternatively, liquid 41 could be a bonding agent (non-toxic to conform to pollution regulations) that would not only replace the air in trash slug 101, but also eliminate the need to tie, bundle or bag the compacted trash slug 101. In either case, if a liquid 41 is used to wet the trash, means must be provided to allow the displaced air and excess liquid to escape. Typically, this would be accomplished by providing vent holes (not shown) in base 11 and/or allowing for a small gap 22 between the outside edges of compacting ram 30 and the inside wall of sleeve 20. Additionally and alternatively, vent holes (not shown) passing through compacting ram 30 may be provided.

To facilitate removal of trash slug 101, a receptacle 50 may be provided that is removably mounted to base 11. Receptacle 50 should be capable of receiving sleeve 20 in its "load and compact" position as shown. A bag (not shown) may also be placed in receptacle 50 in order to neatly enclose trash slug 101 at the end of the cycle.

The advantages of the present invention are numerous. By forming a compacted trash slug according to the above described method and apparatus, high-density and negative buoyancy are achieved. Furthermore, delamination of the compacted trash slug is minimized as the downward compaction force is maintained while the radial restraints on the trash slug are removed.

Figure 4:
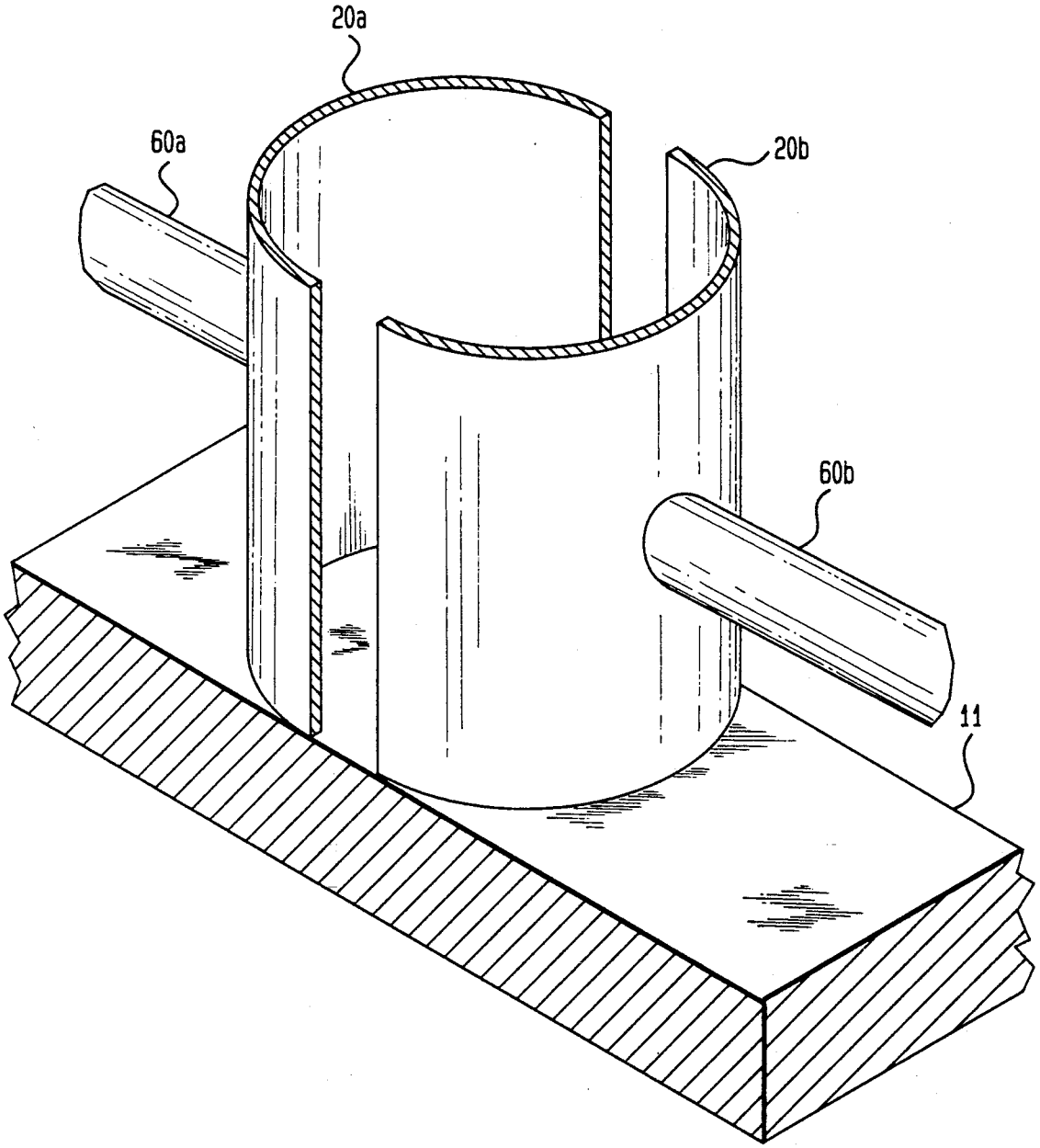
FIG. 4 is a perspective view of an alternative means for forming the compaction chamber used in the method and apparatus of the present invention.

While the present invention has been described relative to a preferred embodiments, several variations are possible without departing from the novel teachings thereof. For instance, as shown in the perspective view of FIG. 4, the sleeve used to form the radial restraints of the compaction chamber may be formed by two half sleeves 20*a* and 20*b* . Sleeves 20*a* and 20*b* could be brought together and separated, as shown, by the action of two hydraulic cylinders 60*a* and 60*b* (shown only in section). Sleeves 20*a* and 20*b* need only be tall enough to form a compaction chamber that will hold a desired amount of trash to be compacted. The advantage of such a design is the elimination of any shear forces acting on the sides of the trash slug as the sleeve 20*a* and 20*b* separates from the trash slug.

Thus, although the invention has been described relative to a specific embodiment thereof, there are numerous variations and modifications that will be readily apparent to those skilled in the art in the light of the above teachings. It is therefore to be understood that, within the scope of the appended claims, the invention may be practiced other than as specifically described.

What is claimed is:

1. A trash compacting apparatus for forming high-density trash slugs of a predetermined height, comprising:

a base a fixed overhead support first and second hydraulic lifting cylinders fixedly mounted to said overhead support, a hollow cylinder connected to said first and second hydraulic lifting cylinders having an open bottom and capable of vertical movement with respect to said base, said cylinder being movable between a first and second position between said base and said support wherein said cylinder's open bottom rests on said base in said first position and wherein said cylinder's open bottom is raised to an ejection height above said base in said second position, said ejection height being greater than the slug's predetermined height;

a compacting ram slidably fitted within said hollow cylinder and disposed above the trash to be compacted;

a third hydraulic cylinder mounted on said ram between the ram and said overhead support for imparting a downward compaction force to said compacting ram to compact the trash within said hollow cylinder between said compacting ram and said base thereby forming the trash slug, wherein the compaction force is applied when said hollow cylinder is in said first position and when said hollow cylinder is moving to said second position, and wherein the compaction force is removed when said hollow cylinder is in said second position, said hollow cylinder having an opening on its side, a shear ram positioned so that its is adjacent said opening when the hollow cylinder is in its said first position, so that trash may be pushed by the ram into the hollow cylinder through said opening, a liquid sprayer positioned externally to said hollow cylinder and adjacent said opening for wetting the trash to be compacted with a liquid.

2. An apparatus as in claim 1 wherein said liquid is seawater.

3. An apparatus as in claim 1 wherein said liquid is a non-toxic bonding agent.

* * * * *